US008967821B2

(12) United States Patent
Pickard

(10) Patent No.: US 8,967,821 B2
(45) Date of Patent: Mar. 3, 2015

(54) LIGHTING DEVICE WITH LOW GLARE AND HIGH LIGHT LEVEL UNIFORMITY

(75) Inventor: Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 247 days.

(21) Appl. No.: 13/425,702

(22) Filed: Mar. 21, 2012

(65) Prior Publication Data

US 2012/0236537 A1 Sep. 20, 2012

Related U.S. Application Data

(63) Continuation of application No. PCT/US2010/049564, filed on Sep. 21, 2010.

(60) Provisional application No. 61/245,688, filed on Sep. 25, 2009.

(51) Int. Cl.

| | |
|---|---|
| ***F21V 9/16*** | (2006.01) |
| ***F21V 7/04*** | (2006.01) |
| ***F21K 99/00*** | (2010.01) |
| ***F21S 8/02*** | (2006.01) |
| ***F21V 7/00*** | (2006.01) |
| ***F21V 9/08*** | (2006.01) |
| ***F21V 11/06*** | (2006.01) |
| *F21Y 101/02* | (2006.01) |

(52) U.S. Cl.

CPC . *F21V 7/041* (2013.01); *F21K 9/00* (2013.01); *F21S 8/02* (2013.01); *F21V 7/0008* (2013.01); *F21V 9/08* (2013.01); *F21V 11/06* (2013.01); *F21Y 2101/02* (2013.01)

USPC ..... 362/84; 362/240

(58) Field of Classification Search

USPC ..... 362/84, 336, 338, 237, 240, 242–243, 362/245, 255–256, 327, 328, 330–332, 335, 362/800

See application file for complete search history.

(56) References Cited

U.S. PATENT DOCUMENTS

| | | | |
|---|---|---|---|
| 3,805,937 | A | 4/1974 | Hatanaka et al. |
| 3,875,456 | A | 4/1975 | Kano et al. |
| 3,927,290 | A | 12/1975 | Denley |
| 4,081,764 | A | 3/1978 | Christmann et al. |
| 4,120,026 | A | 10/1978 | Tsuchihashi et al. |

(Continued)

FOREIGN PATENT DOCUMENTS

| | | |
|---|---|---|
| DE | 39 16 875 | 12/1990 |
| DE | 42 28 895 | 3/1994 |

(Continued)

OTHER PUBLICATIONS

U.S. Appl. No. 13/660,131, filed Oct. 25, 2012, Negley.

(Continued)

*Primary Examiner* — Anne Hines

(74) *Attorney, Agent, or Firm* — Burr & Brown, PLLC

(57) ABSTRACT

A lighting device, comprising at least a first light control element, at least a first light source positioned so that at least a portion of light emitted by the first light source passes through at least a portion of the first light control element and at least a first luminescent material, at least a portion of the first luminescent material being spaced from the first light source, the first luminescent material being positioned so that at least a portion of light emitted by the first light source excites at least a portion of the first luminescent material.

19 Claims, 6 Drawing Sheets

(56) References Cited

U.S. PATENT DOCUMENTS 4,325,146 A 4/1982 Lennington
4,346,275 A 8/1982 Iwakiri
4,408,157 A 10/1983 Beaubien
4,420,398 A 12/1983 Castino
4,710,699 A 12/1987 Miyamoto
4,918,487 A 4/1990 Coulter, Jr.
5,087,883 A 2/1992 Hoffman
5,264,997 A 11/1993 Hutchisson et al.
5,407,799 A 4/1995 Studier
5,410,519 A 4/1995 Hall et al.
5,477,436 A 12/1995 Bertling et al.
5,563,849 A 10/1996 Hall et al.
5,585,640 A 12/1996 Huston et al.
5,614,734 A 3/1997 Guido
5,803,579 A 9/1998 Turnbull et al.
5,813,753 A 9/1998 Vriens et al.
5,851,063 A 12/1998 Doughty et al.
5,959,316 A 9/1999 Lowery
5,962,971 A 10/1999 Chen
6,066,861 A 5/2000 Höhn et al.
6,076,936 A 6/2000 George
6,084,250 A 7/2000 Justel et al.
6,095,666 A 8/2000 Salam
6,132,072 A 10/2000 Turnbull et al.
6,155,699 A 12/2000 Miller et al.
6,212,213 B1 4/2001 Weber et al.
6,234,648 B1 5/2001 Börner
6,245,259 B1 6/2001 Höhn et al.
6,252,254 B1 6/2001 Soules et al.
6,255,670 B1 7/2001 Srivastava et al.
6,278,135 B1 8/2001 Srivastava et al.
6,292,901 B1 9/2001 Lys et al.
6,294,800 B1 9/2001 Duggal et al.
6,319,425 B1 11/2001 Tasaki et al.
6,335,538 B1 1/2002 Prutchi et al.
6,337,536 B1 1/2002 Matsubara et al.
6,340,824 B1 1/2002 Komoto et al.
6,348,766 B1 2/2002 Ohishi et al.
6,350,041 B1 2/2002 Tarsa et al.
6,357,889 B1 3/2002 Duggal et al.
6,373,188 B1 4/2002 Johnson et al.
6,394,621 B1 5/2002 Hanewinkel
6,404,131 B1 6/2002 Kawano et al.
6,429,583 B1 8/2002 Levinson et al.
6,441,558 B1 8/2002 Muthu et al.
6,480,299 B1 11/2002 Drakopoulos et al.
6,490,104 B1 12/2002 Gleckman et al.
6,501,100 B1 12/2002 Srivastava et al.
6,504,179 B1 1/2003 Ellens et al.
6,504,301 B1 1/2003 Lowery
6,513,949 B1 2/2003 Marshall et al.
6,522,065 B1 2/2003 Srivastava et al.
6,538,371 B1 3/2003 Duggal et al.
6,547,249 B2 4/2003 Collins, III
6,550,949 B1 4/2003 Bauer et al.
6,552,495 B1 4/2003 Chang
6,573,537 B1 6/2003 Steigerwald et al.
6,576,488 B2 6/2003 Collins, III et al.
6,576,930 B2 6/2003 Reeh et al.
6,577,073 B2 6/2003 Shimizu et al.
6,578,986 B2 6/2003 Swaris et al.
6,592,810 B2 7/2003 Nishida et al.
6,600,175 B1 7/2003 Baretz et al.
6,600,324 B2 7/2003 St-Germain
6,603,258 B1 8/2003 Mueller-Mach et al.
6,608,485 B2 8/2003 St-Germain
6,616,862 B2 9/2003 Srivastava
6,624,350 B2 9/2003 Nixon et al.
6,635,503 B2 10/2003 Andrews et al.
6,636,003 B2 10/2003 Rahm et al.
6,642,618 B2 11/2003 Yagi et al.
6,642,652 B2 11/2003 Collins, III et al.
6,642,666 B1 11/2003 St-Germain
6,685,852 B2 2/2004 Setlur et al.
6,686,691 B1 2/2004 Mueller et al.
6,692,136 B2 2/2004 Marshall et al.
6,703,173 B2 3/2004 Lu et al.
6,712,486 B1 3/2004 Popovich et al.
6,737,801 B2 5/2004 Ragle
6,744,194 B2 6/2004 Fukasawa et al.
6,762,563 B2 7/2004 St-Germain
6,767,111 B1 7/2004 Lai
6,784,463 B2 8/2004 Camras et al.
6,791,119 B2 9/2004 Slater et al.
6,791,257 B1 9/2004 Sato et al.
6,800,500 B2 10/2004 Coman et al.
6,809,347 B2 10/2004 Tasch et al.
6,817,735 B2 11/2004 Shimizu et al.
6,821,804 B2 11/2004 Thibeault et al.
6,841,804 B1 1/2005 Chen et al.
6,851,834 B2 2/2005 Leysath
6,880,954 B2 4/2005 Ollett et al.
6,882,101 B2 4/2005 Ragle
6,885,035 B2 4/2005 Bhat et al.
6,890,085 B2 5/2005 Hacker
6,914,267 B2 7/2005 Fukasawa et al.
6,936,857 B2 8/2005 Doxsee et al.
6,939,481 B2 9/2005 Srivastava et al.
6,957,899 B2 10/2005 Jiang et al.
6,963,166 B2 11/2005 Yano et al.
6,967,116 B2 11/2005 Negley
6,972,438 B2 12/2005 Lie et al.
7,005,679 B2 2/2006 Tarsa et al.
7,008,078 B2 3/2006 Shimizu et al.
7,009,199 B2 3/2006 Hall
7,009,343 B2 3/2006 Lim et al.
7,014,336 B1 3/2006 Ducharme et al.
7,015,511 B2 3/2006 Sakai et al.
7,023,019 B2 4/2006 Maeda et al.
7,029,935 B2 4/2006 Negley et al.
7,061,454 B2 6/2006 Sasuga et al.
7,066,623 B2 6/2006 Lee et al.
7,083,302 B2 8/2006 Chen et al.
7,093,958 B2 8/2006 Coushaine
7,095,056 B2 8/2006 Vitta
7,102,172 B2 9/2006 Lynch et al.
7,135,664 B2 11/2006 Vornsand et al.
7,153,015 B2 12/2006 Brukilacchio
7,164,231 B2 1/2007 Choi et al.
7,207,691 B2 4/2007 Lee et al.
7,213,940 B1 5/2007 Van De Ven et al.
7,213,942 B2 5/2007 Jiang et al.
7,215,074 B2 5/2007 Shimizu et al.
7,221,044 B2 5/2007 Fan et al.
7,232,212 B2 6/2007 Iwase
7,239,085 B2 7/2007 Kawamura
7,250,715 B2 7/2007 Mueller et al.
7,255,457 B2 8/2007 Ducharme et al.
7,256,557 B2 8/2007 Lim et al.
7,329,024 B2 2/2008 Lynch et al.
7,332,746 B1 2/2008 Takahashi et al.
7,334,917 B2 2/2008 Laski
7,358,954 B2 4/2008 Negley
7,360,937 B2 4/2008 Han et al.
7,422,504 B2 9/2008 Maeda et al.
7,453,195 B2 11/2008 Radkov
7,462,502 B2 12/2008 Paolini et al.
7,474,044 B2 1/2009 Ge
7,479,662 B2 1/2009 Soules et al.
7,614,759 B2 11/2009 Negley
7,791,092 B2 9/2010 Tarsa et al.
7,869,483 B2 1/2011 Uchida et al.
8,067,254 B2 11/2011 Camras et al.
8,264,138 B2 9/2012 Negley et al.
2001/0000622 A1 5/2001 Reeh et al.
2001/0002049 A1 5/2001 Reeh et al.
2002/0015013 A1 2/2002 Ragle
2002/0039002 A1 4/2002 Fukasawa et al.
2002/0070681 A1 6/2002 Shimizu et al.
2002/0084748 A1 7/2002 Ayala et al.
2002/0087532 A1 7/2002 Barritz et al.
2002/0149314 A1 10/2002 Takahashi et al.
2002/0153835 A1 10/2002 Fujiwara
2002/0163302 A1 11/2002 Nitta

(56) References Cited

U.S. PATENT DOCUMENTS

2002/0171911 A1 11/2002 Maegawa
2002/0190637 A1 12/2002 Matsubara et al.
2003/0026096 A1 2/2003 Zwaschka et al.
2003/0030063 A1 2/2003 Sosniak et al.
2003/0042908 A1 3/2003 St-Germain
2003/0042914 A1 3/2003 St-Germain
2003/0067302 A1 4/2003 St-Germain
2003/0067773 A1 4/2003 Marshall et al.
2003/0089918 A1 5/2003 Hiller et al.
2003/0124752 A1 7/2003 Wei et al.
2003/0141506 A1 7/2003 Sano et al.
2003/0146411 A1 8/2003 Srivastava et al.
2003/0151361 A1 8/2003 Ishizaka
2003/0209714 A1 11/2003 Taskar
2003/0209997 A1 11/2003 St-Germain et al.
2003/0214817 A1 11/2003 Hacker
2003/0222268 A1 12/2003 Yocom et al.
2003/0230751 A1 12/2003 Harada
2004/0012027 A1 1/2004 Keller et al.
2004/0046178 A1 3/2004 Sano
2004/0104391 A1 6/2004 Maeda et al.
2004/0105261 A1 6/2004 Ducharme et al.
2004/0105264 A1 6/2004 Spero
2004/0150997 A1 8/2004 Ouderkirk et al.
2004/0021299 A1 10/2004 Mahacsi
2004/0217364 A1 11/2004 Tarsa et al.
2004/0218387 A1 11/2004 Gerlach
2004/0218390 A1 11/2004 Holman et al.
2004/0222735 A1 11/2004 Ragle
2004/0252962 A1 12/2004 Ryan
2004/0264193 A1 12/2004 Okumura
2005/0002191 A1 1/2005 Shimizu et al.
2005/0030744 A1 2/2005 Ducharme et al.
2005/0052378 A1 3/2005 Hacker
2005/0057917 A1 3/2005 Yatsuda et al.
2005/0082562 A1 4/2005 Ou et al.
2005/0082974 A1 4/2005 Fukasawa et al.
2005/0093008 A1 5/2005 Suehiro et al.
2005/0093430 A1 5/2005 Ibbetson et al.
2005/0117334 A1 6/2005 Lee et al.
2005/0127381 A1 6/2005 Vitta et al.
2005/0156496 A1 7/2005 Takashima et al.
2005/0184638 A1 8/2005 Mueller et al.
2005/0227569 A1 10/2005 Maeda et al.
2005/0231948 A1 10/2005 Pohlert et al.
2005/0243556 A1 11/2005 Lynch
2005/0251698 A1 11/2005 Lynch et al.
2005/0253151 A1 11/2005 Sakai et al.
2005/0259423 A1 11/2005 Heuser et al.
2005/0274972 A1 12/2005 Roth et al.
2006/0002141 A1 1/2006 Ouderkirk et al.
2006/0012298 A1 1/2006 Lee et al.
2006/0012989 A1 1/2006 Lee et al.
2006/0022582 A1 2/2006 Radkov
2006/0040416 A1 2/2006 Sano
2006/0060872 A1 3/2006 Edmond et al.
2006/0060888 A1 3/2006 Kim et al.
2006/0067073 A1 3/2006 Ting
2006/0071589 A1 4/2006 Radkov
2006/0105482 A1 5/2006 Alferink et al.
2006/0113548 A1 6/2006 Chen et al.
2006/0120073 A1 6/2006 Pickard et al.
2006/0138435 A1 6/2006 Tarsa et al.
2006/0138937 A1 6/2006 Ibbetson
2006/0154392 A1 7/2006 Tran et al.
2006/0180818 A1 8/2006 Nagai et al.
2006/0181192 A1 8/2006 Radkov et al.
2006/0245184 A1 11/2006 Galli
2006/0255341 A1 11/2006 Pinnington et al.
2007/0001188 A1 1/2007 Lee
2007/0041220 A1 2/2007 Lynch
2007/0051966 A1 3/2007 Higashi et al.
2007/0090381 A1 4/2007 Otsuka et al.
2007/0091601 A1* 4/2007 Hsieh et al. ..... 362/244
2007/0137074 A1 6/2007 Van de Ven et al.
2007/0139920 A1 6/2007 Van de Ven et al.
2007/0139923 A1 6/2007 Negley et al.
2007/0170447 A1 7/2007 Negley
2007/0171145 A1 7/2007 Coleman et al.
2007/0202623 A1 8/2007 Gao et al.
2007/0215890 A1 9/2007 Harbers et al.
2007/0223219 A1 9/2007 Medendorp et al.
2007/0236911 A1 10/2007 Negley
2007/0247414 A1 10/2007 Roberts
2007/0247847 A1 10/2007 Villard
2007/0262337 A1 11/2007 Villard
2007/0263377 A1 11/2007 Butler
2007/0263393 A1 11/2007 Van de Ven et al.
2007/0267983 A1 11/2007 Van de Ven et al.
2007/0274063 A1 11/2007 Negley
2007/0274080 A1 11/2007 Negley et al.
2007/0276606 A1 11/2007 Radkov et al.
2007/0278503 A1 12/2007 Van de Ven et al.
2007/0278934 A1 12/2007 Van de Ven et al.
2007/0278974 A1 12/2007 Van de Ven
2007/0279440 A1 12/2007 Negley
2007/0279903 A1 12/2007 Negley
2007/0280624 A1 12/2007 Negley et al.
2008/0030993 A1 2/2008 Narendran et al.
2008/0048200 A1 2/2008 Mueller et al.
2008/0054281 A1 3/2008 Narendran et al.
2008/0080165 A1 4/2008 Kim et al.
2008/0084685 A1 4/2008 Van de Ven et al.
2008/0084700 A1 4/2008 Van De Ven et al.
2008/0084701 A1 4/2008 Van de Ven et al.
2008/0088248 A1 4/2008 Myers
2008/0089053 A1 4/2008 Negley
2008/0093615 A1 4/2008 Lin et al.
2008/0094829 A1 4/2008 Narendran et al.
2008/0105887 A1 5/2008 Narendran et al.
2008/0106895 A1 5/2008 Van de Ven
2008/0106907 A1 5/2008 Trott et al.
2008/0112168 A1 5/2008 Pickard et al.
2008/0112170 A1 5/2008 Trott et al.
2008/0112183 A1 5/2008 Negley
2008/0117500 A1 5/2008 Narendran et al.
2008/0130265 A1 6/2008 Negley
2008/0130285 A1 6/2008 Negley
2008/0136313 A1 6/2008 Negley
2008/0137347 A1 6/2008 Trott et al.
2008/0170396 A1 7/2008 Yuan et al.
2008/0179602 A1 7/2008 Negley
2008/0192462 A1 8/2008 Steadly et al.
2008/0192493 A1 8/2008 Villard
2008/0211416 A1 9/2008 Negley et al.
2008/0218993 A1* 9/2008 Li ..... 362/84
2008/0231201 A1 9/2008 Higley et al.
2008/0259589 A1 10/2008 Van de Ven et al.
2008/0278928 A1 11/2008 Van de Ven et al.
2008/0278940 A1 11/2008 Van de Ven et al.
2008/0278950 A1 11/2008 Pickard et al.
2008/0278952 A1 11/2008 Trott et al.
2008/0284329 A1 11/2008 Bertram et al.
2008/0304260 A1 12/2008 Van de Ven et al.
2008/0304261 A1 12/2008 Van de Ven et al.
2008/0304269 A1 12/2008 Pickard et al.
2008/0309255 A1 12/2008 Myers
2008/0310154 A1 12/2008 Van de Ven et al.
2008/0315228 A1 12/2008 Krames et al.
2009/0002986 A1 1/2009 Medendorp
2009/0101930 A1 4/2009 Li
2009/0173958 A1 7/2009 Chakraborty et al.
2010/0020532 A1 1/2010 Negley
2010/0246160 A1 9/2010 Ito et al.
2010/0290221 A1 11/2010 Tarsa et al.
2010/0328926 A1 12/2010 Hoelen et al.
2011/0018013 A1 1/2011 Margalith et al.
2011/0132521 A1 6/2011 Paolini et al.
2012/0018754 A1 1/2012 Lowes et al.

FOREIGN PATENT DOCUMENTS

DE 103 35 077 3/2005
EP 0 838 866 4/1998

(56) References Cited

FOREIGN PATENT DOCUMENTS

| | | | |
|---|---|---|---|
| EP | 0 971 421 | | 1/2000 |
| EP | 1 024 399 | | 8/2000 |
| EP | 1 059 667 | | 12/2000 |
| EP | 1 059 678 | A2 | 12/2000 |
| EP | 1 081 771 | | 7/2001 |
| EP | 1 160 883 | | 12/2001 |
| EP | 1 193 772 | | 4/2002 |
| EP | 1 367 655 | | 12/2003 |
| EP | 1 462 711 | | 9/2004 |
| EP | 1 526 057 | | 4/2005 |
| EP | 1 566 848 | | 8/2005 |
| EP | 1 571 715 | | 9/2005 |
| EP | 1 760 795 | | 3/2007 |
| GB | 2 282 700 | | 4/1995 |
| GB | 2 366 610 | | 3/2002 |
| JP | 50-8494 | | 1/1975 |
| JP | 07-176794 | | 7/1995 |
| JP | 08-007614 | | 1/1996 |
| JP | 08007614 | | 1/1996 |
| JP | 09-153646 | | 6/1997 |
| JP | 10-163535 | | 6/1998 |
| JP | 2000-022222 | | 1/2000 |
| JP | 2000-183408 | | 6/2000 |
| JP | 2000-353826 | | 12/2000 |
| JP | 2001-53341 | | 2/2001 |
| JP | 2001-1111114 | | 4/2001 |
| JP | 2001-1156331 | | 6/2001 |
| JP | 2001-307506 | | 11/2001 |
| JP | 2002-150821 | | 5/2002 |
| JP | 2002-299699 | | 10/2002 |
| JP | 2003-515956 | | 5/2003 |
| JP | 2003-529889 | | 10/2003 |
| JP | 2003-347601 | | 12/2003 |
| JP | 2004-031856 | | 1/2004 |
| JP | 2004-56075 | | 2/2004 |
| JP | 2004-071357 | | 3/2004 |
| JP | 2004-080046 | | 3/2004 |
| JP | 2004-103443 | | 4/2004 |
| JP | 2004-191718 | | 7/2004 |
| JP | 2004-253309 | | 9/2004 |
| JP | 2004-356116 | | 12/2004 |
| JP | 2004-363055 | | 12/2004 |
| JP | 2005-005482 | | 1/2005 |
| JP | 2005-8844 | | 1/2005 |
| JP | 2005-101296 | | 4/2005 |
| JP | 2005-142311 | | 6/2005 |
| JP | 2005-191514 | | 7/2005 |
| JP | 2005-277127 | | 10/2005 |
| JP | 2005-332963 | | 12/2005 |
| JP | 2006-049799 | | 2/2006 |
| JP | 2007-122950 | | 5/2007 |
| JP | 2007-141737 | | 6/2007 |
| TW | 546854 | | 8/2003 |
| WO | 98/43014 | | 10/1998 |
| WO | 00/19546 | | 4/2000 |
| WO | 00/34709 | | 6/2000 |
| WO | 01/41225 | | 6/2001 |
| WO | 01/69692 | | 9/2001 |
| WO | 03/065464 | | 8/2003 |
| WO | 2004/068597 | A2 | 8/2004 |
| WO | 2004/068909 | | 8/2004 |
| WO | 2004/100226 | A2 | 11/2004 |
| WO | 2004/100279 | | 11/2004 |
| WO | 2004/100611 | | 11/2004 |
| WO | 2005/004202 | | 1/2005 |
| WO | 2005/013365 | | 2/2005 |
| WO | 2005/124877 | | 12/2005 |
| WO | 2006/028312 | | 3/2006 |
| WO | 2006/061728 | | 6/2006 |
| WO | 2006/099741 | | 9/2006 |
| WO | 2007/002234 | | 1/2007 |
| WO | 2007/061758 | | 5/2007 |
| WO | 2007/063460 | | 6/2007 |
| WO | 2009/072575 | | 6/2009 |
| WO | 2009/107052 | | 9/2009 |

OTHER PUBLICATIONS

LEDsMagazine, *Technology and Applications of LEDs*, Apr. 14, 2005, http://www.ledsmagazine.com/news/2/4/22, pp. 1.

High Efficiency, Nitride-Based, Solid-State Lighting, Summary of UCSB Research, Summary of LRC Research, www.lrc.rpi.edu/programs/solidstate/cr_nitridebasedssl.asp, pp. 1-2, (date not known).

Narendran, *Improving the performance of mixed-color white LED systems by using scattered photon extraction technique*, 2007 Copyright SPIE, The International Society for Optical Engineering, Seventh International Conference on Solid State Lighting, Proceedings of SPIE, Sep. 17, 2007, pp. 1-2.

Narendran, *Improved Performance White LED*, Nov. 2005, Society of Photo-Optical Instrumentation Engineers, Fifth International Conference on Solid State Lighting, Proceedings of SPIE 5941, pp. 1-7.

Narendran et al., Extracting phosphor-scattered photons to improve white LED efficiency, Wiley InterScience :: Journals :: physica status solidi (a), Rapid Research Letter, Mar. 17, 2005, http://www3.interscience.wiley.com/journa1/110437401/abstract, Abstract.

LRC Solid-State Lighting Papers and Publications, pp. 1-4, Feb. 2, 2006.

Zhu et al., "Optimizing the Performance of Remote Phosphor LED," First International Conference on White LEDs and Solid State Lighting, 2007, pp. 1-5.

Kim et al., "Strongly Enhanced Phosphor Efficiency in GaInN White Light-Emitting Diodes Using Remote Phosphor Configuration and Diffuse Reflector Cup", Japanese Journal of Applied Physics, vol. 44, Nov. 21, 2005, pp. L649-L651.

Van de Ven et al., "Warm White Illumination with High CRI and High Efficacy by Combining 455 nm Excited Yellowish Phosphor LEDs and Red AlInGaP LEDs", First International Conference on White LEDs and Solid State Lighting.

Cree® XLamp® 7090 XR-E Series LED Binning and Labeling.

Chhajed, S., *Influence of junction temperature on chromaticity and color-rendering properties of trichromatic white-light sources* . . . , Journal of Applied Physics, 2005, vol. 97, pp. 1-8.

Color Kinetics Inc., *Color Quality of Intelligent Solid-State Light Systems*, Color Quality of Solid-State Light Sources, Mar. 2005, pp. 1-3.

Narendran et al., *Color Rendering Properties of LED Light Sources*, Lighting Reserach Center, Renssalaer Polytechnic Institute, pp. 1-8, 2002.

Color Kinetics Support : White Papers & Presentations; *Solid State Lighting White Papers & Presentations*; http://www.colorkinetics.com/support/whitepapers/; pp. 1-4, Feb. 22, 2006.

Shimizu, Yoshinori, "Development of High-Efficiency LED Downlight", Proceeding to the First International Conference on White LEDs and Solid State Lighting, Nov. 26, 2007, pp. 1-5.

Press Release from LED Lighting Fixtures dated Apr. 24, 2006 entitled "LED Lighting Fixtures, Inc. achieves unprecedented gain in light output from new luminaire".

Press Release from LED Lighting Fixtures dated Feb. 16, 2006 entitled "LED Lighting Fixtures, Inc. Announces Record Performance".

Press Release from LED Lighting Fixtures dated Feb. 7, 2007 entitled "LED Lighting Fixtures Announces its first LED-based Recessed Down Light".

Press Release from LED Lighting Fixtures dated May 30, 2006 entitled "LED Lighting Fixtures, Inc. Sets World Record at 80 Lumens per Watt for Warm White Fixture".

Narendran et al., "Solid State lighting: failure analysis of white LEDs," (Abstract Only), Jun. 11, 2004, pp. 1-2.

Nichia, White Light LED, Part Nos. NSPW300BS and NSPW312BS, High Brightness LEDs, Nov. 12, 1999, Publisher: Nichia Corporation.

Permlight Inc., *Enbryten LED Product Information*, Feb. 2005, Publisher: Permlight Inc. website; accessed at http://www.webarchive.org displaying that www.permlight.com/products/LEDfixtures.asp was publicly available Jan. 2004.

Optoled Lighting Inc., *OptoLED Product Information*, 2009, Publisher: OptoLED GmBH website: accessed at http://222.optoled.de/englisch/products/led.html.

(56) References Cited

OTHER PUBLICATIONS

Krames et al., *Lumileds Lighting, Light from Silicon Valley*, Progress and Future Direction of LED Technology, SSL Workshop, Nov. 13, 2003, Publisher: Limileds Lighting Inc., pp. 1-21.
Compound Semiconductors Online, "LED Lighting Fixtures, Inc. Sets World Record at 80 Lumens per Watt for Warm White", Compound Semiconductors Online, May 30, 2006, pp. 1.
CSA International, "Test Data Report," Project No. 1786317, Report No. 1786317-1 (Apr. 20, 2006).
DOE SSL CALiPer Report, "Product Test Reference: CALiPER 07-31 Downlight Lamp".
Press Release from LED Lighting Fixtures dated Jan. 26, 2006 entitled "LED Lighting Fixtures Creates 750 Lumen Recessed Light and Uses Only 16 Watts of Power".
DOE SSL CALiPer Report, "Product Test Reference: CALiPER 07-47 Downlight Lamp".
U.S. Department of Energy, "DOE Solid-State Lighting CALiPER Program, Summary of Results: Round 3 of Product Testing," Oct. 2007.
U.S. Department of Energy, "DOE Solid-State Lighting CALiPER Program, Summary of Results: Round 4 of Product Testing," Jan. 2008.
U.S. Department of Energy, "DOE Solid-State Lighting CALiPER Program, Summary of Results: Round 5 of Product Testing," May 2008.
Web page, Product overview sheets for "Lexel" available from http://web.archive.org/web/s0070106231922/http://tirsys.com/technology/index.htm as retrieved Jan. 6, 2007.
Light Emitting Diodes (LEDs) for General Illumination, OIDA, edited by Tsao, J.Y. Sandia National Laboratories, Oct. 2002 available at http://lighting.sandia.gov/lgithingdocs/OIDA SSL LED Roadmap Full.pdf as retrieved on Jun. 10, 2004.
Narukawa, Ykio, Narita, Junya; Sakamoto, Takahiko; Deguchi, Kouichiro; Yamada, Tako; and Mukei Takashi, "Ultra-High Efficiency White Light Emitting Diodes", Japanese Journal of Applied Physics, vol. 45, No. 41, 2006, pp. L1084-L1086.
Zukausakas, A., Shuir M.S., Gaska, R., Introduction to Solid-State Lighting:, John Wiley & Sons, 2002, (Section 6.1 pp. 118-122).
Duggal, A. "Organic Electroluminescence" edited by Zakya Kafafi, CRC Press, 2005, p. 437-466.
Schubert, E.F., "Light-Emitting Diodes" 2nd ed. Cambridge University Press, 2006, Chapter 21, pp. 346-366.
Chinese Office Action dated Aug. 5, 2013 (and translation provided by foreign counsel), pp. 1-13.
EPO Examination Report from a corresponding European patent application bearing a mailing date of May 23, 2014, 5 pages.
Chinese Office Action (and translation provided by foreign counsel) from a corresponding Chinese patent application bearing a mailing date of Nov. 13, 2014, 12 pages.

* cited by examiner

LIGHTING DEVICE WITH LOW GLARE AND HIGH LIGHT LEVEL UNIFORMITY

CROSS-REFERENCE TO RELATED APPLICATIONS

This application is a National Phase of International Application No. PCT/US 10/49564 having an international filing date of Sep. 21, 2010, published in English on Mar. 31, 2011, which claims the benefit of U.S. Patent Application No. 61/245,688, filed Sep. 25, 2009, the entirety of which is incorporated herein by reference as if set forth in its entirety.

FIELD OF THE INVENTIVE SUBJECT MATTER

The present inventive subject matter relates to a lighting device that provides low glare and good uniformity of light level. In some embodiments, the present inventive subject matter relates to a lighting device that includes one or more solid state light emitting devices, e.g., one or more light emitting diodes.

BACKGROUND

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting (of all types, including general illumination) that is more energy-efficient, without sacrificing other desired properties of lighting (or limiting detraction of other desired properties).

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

The color of visible light output by a light emitter, and/or the color of blended visible light output by a plurality of light emitters can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular color. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent.

A series of points that is commonly represented on the CIE Diagrams is referred to as the blackbody locus. The chromaticity coordinates (i.e., color points) that lie along the blackbody locus obey Planck's equation: $E(\lambda)=A\lambda^{-5}/(e^{B/T})-1)$, where E is the emission intensity, $\lambda$ is the emission wavelength, T is the color temperature of the blackbody and A and B are constants. The 1976 CIF, Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

The emission spectrum of any particular light emitting diode is typically concentrated around a single wavelength (as dictated by the light emitting diode's composition and structure), which is desirable for some applications, but not desirable for others, (e.g., for providing general illumination, such an emission spectrum provides a very low CRI Ra).

Because light that is perceived as white is necessarily a blend of light of two or more colors (or wavelengths), no single light emitting diode junction has been developed that can produce white light.

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

There are many situations where it is desired for the intensity of light exiting a lighting device to be highly uniform. For instance, with general illumination devices, it is often desired to have a lighting device where the variance of intensity between different locations from which light exits the lighting device (e.g., the lens) is limited or minimized. The challenges presented by a desire for uniformity can be increased where the size of the region from which light is emitted is increased, e.g., in the case of troffer lights, which are often designed to fit in square spaces in ceilings measuring roughly two feet by two feet or in rectangular spaces in ceilings measuring roughly two feet by four feet.

There are many situations where it is desired for the light exiting a lighting device to create less glare. Again, such challenges can be more pronounced with lights having larger areas of light emission.

For the above and other reasons, there is an ongoing need for a lighting device that provides good efficiency, good color uniformity of emitted light, good intensity uniformity of emitted light, and/or low glare. In some cases, it is further desired that the light emitted from the lighting device be white and have acceptable color temperature and/or high CRI Ra, and/or that the lighting device have a long useful life.

BRIEF SUMMARY OF THE INVENTIVE SUBJECT MATTER

Excellent uniformity of light level across a surface of emission for a lighting device can be achieved in accordance with the present inventive subject matter by providing a combination of (1) at least one luminescent material that is spaced from light sources, and (2) at least one light control element. Excellent uniformity of light level and color can be achieved in accordance with the present inventive subject matter even where the source (or sources) of light within the lighting device comprises one or more solid state light emitters, for example, light emitting diodes that respectively emit light of at least two different colors (such as blue and red).

In one aspect of the present inventive subject matter, there is provided a lighting device that comprises at least one light control element.

In another aspect of the present inventive subject matter, there is provided a lighting device that comprises a first light source and at least a first luminescent material that is spaced from the first light source.

In another aspect of the present inventive subject matter, there is provided a lighting device that comprises a first luminescent material and at least one light control element.

In another aspect of the present inventive subject matter, there is provided a lighting device that comprises a first light source, a first luminescent material and at least one light control element.

In another aspect of the present inventive subject matter, there is provided a lighting device, comprising:

at least a first light control element;

at least a first light source positioned so that at least a portion of light emitted by the first light source passes through at least a portion of the first light control element; and at least a first luminescent material, at least a portion of the first luminescent material being spaced from the first light source, the first luminescent material being positioned so that at least a portion of light emitted by the first light source excites at least a portion of the first luminescent material.

In some embodiments according to the present inventive subject matter, the lighting device further comprises at least a first light control element which comprises one or more volumetric light control structure and/or one or more surface light control feature. In some of such embodiments, at least a portion of the first luminescent material is positioned on at least one surface of the first light control element and/or within the first light control element.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
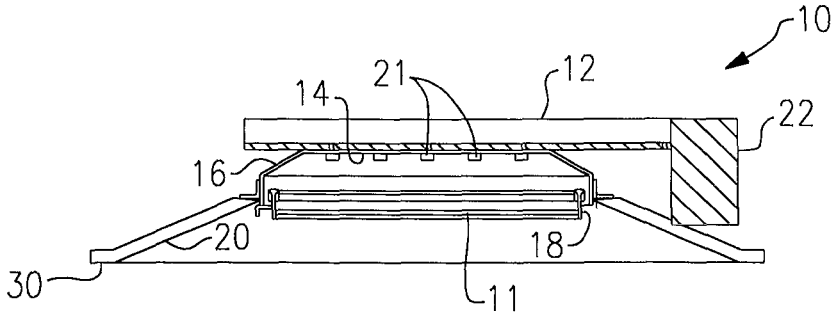
FIG. 1 is a cross-sectional view of a lighting device 10 according to the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items. All numerical quantities described herein are approximate and should not be deemed to be exact unless so stated.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The term "illumination" (or "illuminated"), as used herein means that a light source is emitting electromagnetic radiation. For example, the term "illumination" means that at least some current is being supplied to the light source to cause the light source to emit at least some electromagnetic radiation (in some cases, with at least a portion of the emitted radiation having a wavelength between 100 nm and 1000 nm, and in some cases within the visible spectrum). The expression "illuminated" also encompasses situations where the light source emits light continuously or intermittently at a rate such that if it is or was visible light, a human eye would perceive it as emitting light continuously (or discontinuously), or where a plurality of light sources (especially in the case of solid state light emitters) that emit light of the same color or different colors are emitting light intermittently and/or alternatingly (with or without overlap in "on" times) in such a way that if they were or are visible light, a human eye would perceive them as emitting light continuously or discontinuously (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting-work lights, etc., mirrors/vanity lighting, or any other light emitting device.

The expression "major surface" as used herein, means a surface which has a surface area which comprises at least 25% of the surface area of the entire structure, and in some cases at least 40% of the surface area of the entire structure (e.g., each of the top and bottom surfaces of a substantially flat thin substrate having substantially parallel top and bottom surfaces).

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one light source in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

The expression "substantially square", as used herein, means that the shape can be placed on x,y coordinates such that at least 90 percent of the points on the shape have an x coordinate or a y coordinate which is within 0.95 to 1.05 times a particular value or the negative of that value, and the absolute value of neither the x coordinate nor the y coordinate exceeds the absolute value of 1.05 times such particular value.

The expression "substantially rectangular", as used herein, means that a rectangular shape can be identified, wherein at least 90% of the points in the item which is characterized as being substantially rectangular fall within the rectangular shape, and the rectangular shape includes at least 90% of the point in the item.

The expression "substantially circular", as used herein, means that a circle can be drawn having the formula $x^2+y^2=n$, where imaginary axes could be drawn at a location where for each of at least 80% of the points on the feature being characterized as "substantially circular", the y coordinate would be within 0.95 to 1.05 times the value obtained by inserting the x coordinate of such point into such formula.

In one aspect of the present inventive subject matter, there is provided a lighting device, comprising at least a first light control element, at least a first light source and at least a first luminescent material.

The one or more light control element (or elements) employed in lighting devices according to the present inventive subject matter can be any structure or feature that alters the overall nature of the pattern formed by light emitted by the first light source. As such, the expression "light control element", as used herein, encompasses films and lenses which comprise one or more volumetric light control structures and/or one or more surface light control features. While films and/or lenses which are merely of indices of refraction that differ from those of adjacent regions, and/or which merely alter the focus of light and/or which assist in diffusion (color mixing) and/or obscuration (depixelization), and/or which are of a substantially uniform thickness or mean thickness, can be included in the lighting devices according to the present inventive subject matter (and in many cases are desired), such films and/or lenses are not encompassed by the expression "light control element" as used herein. In some aspects of the present inventive subject matter, the one or more light control elements are non-imaging optics, i.e., they include diffusers and light shapers/lamp hiders (like acrylic prismatic sheets) and exclude imaging optics (e.g., optics used in telescopes and cameras).

As is well known by persons of skill in the art, light control elements can be in any of a variety of forms, and any suitable ones of such forms can be employed in accordance with the present inventive subject matter. For example, as mentioned above, a light control element can comprise one or more volumetric light control structures and/or one or more surface light control features. A volumetric light control structure is one in which the light control is achieved by regions extending through at least part of the thickness or depth of the light control structure. Persons of skill in the art are familiar with, for example, light control structures in which lenslets are made in at least part of the volume of a structure, e.g., in which diffusion elements are contained within pellets, which are worked in bulk and later molded (e.g., injection molded) or extruded. Likewise, light control can be provided by regions in at least part of the thickness or depth of a film (as is known to those of skill in the art, such films are contrasted with molded or extruded lenses in that such films, e.g., several thousandths of an inch up to 10 or 20 thousandths of an inch, cannot be scaled up to significantly larger thicknesses). As an example of a method of making such a film, a base stock can be mixed with a material (or materials) of index of refraction that differs from that of the base stock to form a controlled dispersion, which is then extruded.

A surface light control feature, as contrasted from a volumetric light control structure, is a surface feature, i.e., it is formed on a surface of a structure, e.g., a lens or a film. Persons of skill in the art are familiar with a variety of surface light control features and ways to provide them. Representative examples of ways to provide surface light control features include mechanically pressing a film or a lens, molding surface light control features (e.g., injection molding using a mold which has surface features that will impart in the injection molded structures one or more surface light control features), and patterning (e.g., by photolithography) on a film or lens (patterning by photolithography is typically used on films, but it could be used on lenses, if desired).

With respect to light control elements that comprise one or more volumetric light control structures, the light control structure(s) can be located in any suitable portion of the light control element, e.g., the top half, the bottom half, substantially the entirety, or any other portion. With respect to light control elements that comprise one or more surface features, the surface feature(s) can be located on either (or both) sides of the light control element, and can extend across any portion (or substantially all) of such surface(s).

Persons of skill in the art are also familiar with a variety of light control feature effects. For example, one well known type of light control effect is collimation (also known as beam shaping), the broadest sense of which is affecting the direction in which a significant portion of light travels. One example of a type of collimation is where a significant portion (e.g., at least 50%, in some cases at least 60%, and in some cases at least 70%, 80%, 90%, 95%, 99% or more) of incident light is caused to travel substantially perpendicularly to a surface of the light control element. For example, one of the first types of light control element was designed to transmit a larger percentage of light traveling in a direction substantially perpendicular to a surface of the structure facing the light than the percentage of light traveling in a direction that defines an angle of less than 45 degrees relative to the surface of the structure facing the light (in other words, with such elements, light that strikes the light control element perpendicularly is more likely to pass through the light control element than light that strikes the light control element obliquely). Another well known type of light control effect is distribution, i.e., affecting the amount of light that goes to a given region. For example, one example of a type of light control distribution effect is referred to as a "bat wing distribution", where comparatively less light is directed to a location directly below the lighting device and comparatively more light is directed to locations spaced from directly below the lighting device (or to only one side of a location directly below the lighting device, or to only two sides of such location, etc.), e.g., to counteract the effect, caused by intensity falling as the square of the distance, of light being comparatively brighter directly below the lighting device (and sometimes at locations near locations that are directly below the lighting device).

The one or more light control elements can be formed of any material (or materials) and can be of any size and shape, so long as it alters the overall nature of the pattern formed by light emitted by at least the first light source.

In some embodiments, the light control element has first and second major surfaces that are substantially parallel to each other, and the light control element has a thickness (i.e., a dimension substantially perpendicular to the first and second major surfaces) that is much smaller than the dimensions of the major surfaces, e.g., less than one fifth (and in some embodiments, less than one tenth or less than one twentieth) of a dimension of one or both of the major surfaces.

The light control element (or elements) used in the lighting devices according to the present inventive subject matter can also be selected from among any of the known light control elements. Representative examples of suitable light control elements includes those disclosed in U.S. Pat. No. 5,147,716 and U.S. Patent Application Publication No. 2009/0115943, the entireties of which are hereby incorporated by reference as if set forth in their entirety.

Each of the one or more light sources can be selected from among any or all of the wide variety of light sources known to persons of skill in the art. Representative examples of types of light sources include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc., each with or without one or more filters. That is, the at least one light source can comprise a single light source, a plurality of light sources of a particular type, or any combination of one or more light sources of each of a plurality of types.

A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

A luminescent material is a material that emits a responsive radiation (e.g., visible light) when excited by a source of exciting radiation. In many instances, the responsive radiation has a wavelength which is different from the wavelength of the exciting radiation.

Luminescent materials can be categorized as being down-converting, i.e., a material which converts photons to a lower energy level (longer wavelength) or up-converting, i.e., a material which converts photons to a higher energy level (shorter wavelength).

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

One type of luminescent material are phosphors, which are readily available and well known to persons of skill in the art. Other examples of luminescent materials include scintillators, day glow tapes and inks which glow in the visible spectrum upon illumination with ultraviolet light.

The advantage of providing a wider spectrum of visible wavelengths to provide increased CRI (e.g., Ra) is well known, and the ability to predict the perceived color of output light from a lighting device which includes light emitters which output two or more respective colors of light is also well known, e.g., with the assistance of the CIE color charts.

Luminescent material (when included) can be provided in any suitable form. For example, the luminescent element can be embedded in the heat dissipation element and/or in a resin (i.e., a polymeric matrix), such as a silicone material, an epoxy material, a glass material or a metal oxide material. The luminescent material can be contained in an encapsulant in which one or more light source (e.g., a light emitting diode) is embedded.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009-0108269), the entirety of which is hereby incorporated by reference as if set forth in its entirety.

Each of the one or more light sources can be of any suitable shape, a variety of which are known to those of skill in the art, e.g., in the shape of an A lamp, a B-10 lamp, a BR lamp, a C-7 lamp, a C-15 lamp, an ER lamp, an F lamp, a G lamp, a K lamp, an MB lamp, an MR lamp, a PAR lamp, a PS lamp, an R lamp, an S lamp, an S-11 lamp, a T lamp, a Linestra 2-base lamp, an AR lamp, an ED lamp, an E lamp, a BT lamp, a Linear fluorescent lamp, a U-shape fluorescent lamp, a circline fluorescent lamp, a single twin tube compact fluorescent lamp, a double twin tube compact fluorescent lamp, a triple twin tube compact fluorescent lamp, an A-line compact fluorescent lamp, a screw twist compact fluorescent lamp, a globe screw base compact fluorescent lamp, or a reflector screw base compact fluorescent lamp. Lighting devices according to the present inventive subject matter can comprise one or more light sources of a particular shape or one or more light sources of each of a plurality of different shapes.

Each of the one or more light sources can be designed to emit light in any suitable pattern, e.g., in the form of a flood light, a spotlight, a downlight, etc. Lighting devices according to the present inventive subject matter can comprise one or more light sources that emit light in any suitable pattern, or one or more light sources that emit light in each of a plurality of different patterns.

At least a portion of the first luminescent material is spaced from the first light source. The term "spaced", as used herein, means that the first luminescent material is not in direct contact with the first light source. In some embodiments, the first luminescent material is not in direct or indirect contact with the first light source. In some embodiments, the first luminescent material is spaced from the first light source by a distance that is at least as large (and in some embodiments twice as large, and in some embodiments, three, four, five or ten times as large) as a largest dimension of an emission surface of the first light source. In some embodiments, the first luminescent material is spaced from the first light source by at least 30 percent of a smallest dimension of the lighting device.

For example, luminescent material can be provided in or on any suitable element (or elements) in the lighting device. In some embodiments, for instance, luminescent material can be provided in or on a light control element, in or on a diffusion element, in or on an obscuration element, in or on a housing member, in or on a reflector, etc. In embodiments where luminescent material is provided on a surface of a light control element, the luminescent material can be provided on either (or both) surfaces. In some embodiments, for example, luminescent material can be provided on a side (the "smooth side") of the light control element that faces the light source(s) (e.g., one or more light emitting diodes), and a surface light control feature can be provided on a side (the "fuzzy side") of the light control element that faces away from the light source(s).

In general, light of any combination and number of colors can be mixed in lighting devices according to the present inventive subject matter. Representative examples of blends of light colors are described in:

U.S. patent application Ser. No. 11/613,714, filed Dec. 20, 2006 (now U.S. Patent Publication No. 2007/0139920), the entirety of which is hereby incorporated by reference as if set forth in its entirety;

U.S. patent application Ser. No. 11/613,733, filed Dec. 20, 2006 (now U.S. Patent Publication No. 2007/0137074), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/736,799, filed Apr. 18, 2007 (now U.S. Patent Publication No. 2007/0267983), the entirety of which is hereby incorporated by reference as if set forth in its entirety;

U.S. patent application Ser. No. 11/737,321, filed Apr. 19, 2007 (now U.S. Patent Publication No. 2007/0278503), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 12/117,122, filed May 8, 2008 (now U.S. Patent Publication No. 2008/0304260), the entirety of which is hereby incorporated by reference as if set forth in its entirety;

U.S. patent application Ser. No. 12/117,131, filed May 8, 2008 (now U.S. Patent Publication No. 2008/0278940), the entirety of which is hereby incorporated by reference as if set forth in its entirety;

U.S. patent application Ser. No. 12/117,136, filed May 8, 2008 (now U.S. Patent Publication No. 2008/0278928), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/248,220, filed on Oct. 9, 2008 (now U.S. Patent Publication No. 2009/0184616), the entirety of which is hereby incorporated by reference as if set forth in its entirety;

U.S. patent application Ser. No. 11/951,626, filed Dec. 6, 2007 (now U.S. Patent Publication No. 2008/0136313), the entirety of which is hereby incorporated by reference as if set forth in its entirety;

U.S. patent application Ser. No. 12/035,604, filed on Feb. 22, 2008 (now U.S. Patent Publication No. 2008/0259589), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety;

U.S. Patent Application No. 60/990,435, filed on Nov. 27, 2007, entitled "WARM WHITE ILLUMINATION WITH HIGH CRI AND HIGH EFFICACY" (inventors: Antony Paul van de Ven and Gerald H. Negley), the entirety of which is hereby incorporated by reference as if set forth in its entirety; and U.S. patent application Ser. No. 12/541,215, filed Aug. 14, 2009, (now U.S. Patent Publication No. 2011/0037409), the entirety of which is hereby incorporated by reference as if set forth in its entirety.

In some embodiments according to the present inventive subject matter, the lighting devices can further comprise one or more sensors.

Persons of skill in the art are familiar with a wide variety of sensors, and any of such sensors can be employed in the lighting devices of the present inventive subject matter. Among these well known sensors are sensors that are sensitive to all visible light, as well as sensors that are sensitive to only a portion of visible light. For example, the sensor can be a unique and inexpensive sensor (GaP:N light emitting diode) that views the entire light flux but is only (optically) sensitive to one or more of a plurality of light emitting diodes. For instance, in one specific example, the sensor can be sensitive to only a particular range (or ranges) of wavelengths, and the sensor can provide feedback to one or more light sources (e.g., light emitting diodes that emit light of that color or that emit light of other colors) for color consistency as the light sources age (and light output decreases). By using a sensor that monitors output selectively (by color), the output of one color can be selectively controlled to maintain the proper ratios of outputs and thereby maintain the color temperature of the device. This type of sensor is excited by only light having wavelengths within a particular range, e.g., a range that excludes red light (see, e.g., U.S. patent application Ser. No. 12/117,280, filed May 8, 2008 (now U.S. Patent Publication No. 2008/0309255), the entirety of which is hereby incorporated by reference as if set forth in its entirety.

In some embodiments according to the present inventive subject matter, the lighting device further comprises a sensor that detects an intensity of light emitted by one or more strings of light sources (e.g., light emitting diodes) (the expression "string", as used herein, means that at least two light sources are electrically connected in series), and circuitry that adjusts a current supplied to such one or more strings of light sources in response to that intensity. Persons of skill in the art are familiar with a variety of sensors that can detect an intensity of light emitted by one or more light sources, and any of such sensors can be used in making such embodiments. Similarly, persons of skill in the art are familiar with a variety of types of circuitry that can adjust a current supplied to one or more strings of light sources (or adjust currents supplied independently to each of plural strings of light sources) in response to any signal or command (e.g., intensity detected by the sensor(s)), and any of such types of circuitry can be employed in the devices according to the present inventive subject matter. For example, in some embodiments according to the present inventive subject matter, the current supplied to a third string of solid state lighting devices can be set to a particular value for the intensity of the combined light emitted by the solid state lighting devices in first and second strings of solid state lighting devices as detected during testing (i.e., their initial combined intensity), and the current supplied to the third string can be varied (linearly or non-linearly) from that set value in response to variance in the intensity of the combined light emitted by the solid state lighting devices in the first and second strings of solid state lighting devices over time (e.g., as the intensity of the solid state lighting devices in the first and second strings of solid state lighting devices decreases over time, the current supplied to the third string of solid state lighting devices can be varied in order to reduce or minimize deviation of the combined color output of the lighting device over time). Skilled artisans are familiar with a variety of ways to provide such a relationship, e.g., by providing a sensor feedback that, in response to variances in the intensity of the combined light emitted by the light sources in the first and second strings, adjusts a reference voltage for the third string.

Some embodiments of the present inventive subject matter include measuring color output of a lighting device while supplying current to one or more strings of light sources, and adjusting the current supplied to at least one of the first string of light sources. Persons of skill in the art are familiar with a variety of devices and techniques for measuring color output, and any of such devices and techniques can be employed in the devices according to the present inventive subject matter. Similarly, persons of skill in the art are familiar with a wide variety of devices and techniques for adjusting current supplied to one or more strings of light sources, and any of such devices and techniques can be employed in the devices according to the present inventive subject matter. Thus, the currents are tunable based upon characteristics of the specific device (and components thereof) being used.

Other techniques for sensing changes in light output of light sources include providing separate or reference emitters and a sensor that measures the light output of these emitters. These reference emitters are placed so as to be isolated from ambient light such that they typically do not contribute to the light output of the lighting device. Additional techniques for sensing the light output of a light source include measuring ambient light and light output of the lighting device separately and then compensating the measured light output of the light source based on the measured ambient light.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

In accordance with some embodiments of the present inventive subject matter, there are provided devices that comprise a controller configured to control a ratio of light emitted by at least one light source and light emitted by at least a second light source such that a combination of light is a desired color (e.g., white).

Persons of skill in the art are familiar with, have access to, and can readily envision a variety of suitable controllers. For example, a controller may be a digital controller, an analog controller or a combination of digital and analog. For example, the controller may be an application specific integrated circuit (ASIC), a microprocessor, a microcontroller, a collection of discrete components or combinations thereof. In some embodiments, the controller may be programmed to control the one or more light sources. In some embodiments, control of the one or more light sources may be provided by the circuit design of the controller and is, therefore, fixed at the time of manufacture. In still further embodiments, aspects of the controller circuit, such as reference voltages, resistance values or the like, may be set at the time of manufacture so as to allow adjustment of the control of the one or more light sources without the need for programming or control code.

Representative examples of suitable controllers are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety; and U.S. patent application Ser. No. 12/257,804, filed on Oct. 24, 2008 (now U.S. Patent Publication No. 2009/0160363), the entirety of which is hereby incorporated by reference as if set forth in its entirety.

Some embodiments in accordance with the present inventive subject matter include one or more diffusion elements and/or one or more obscuration elements. Persons of skill in the art are familiar with a wide variety of diffusion elements (i.e., elements that assist in color mixing), and a wide variety of obscuration elements (i.e., volumetric regions and/or surface features), and can readily envision a variety of materials out of which a diffusion element or an obscuration element can be made, and are familiar with and/or can envision a wide variety of shapes that such elements can be. Any of such materials and/or shapes can be employed in a diffusion element and/or an obscuration element in an embodiment that includes such an element (or elements). As will be understood by persons skilled in the art, a diffusion element or an obscuration element according to the present inventive subject matter can be selected based on their respective effects on incident light. For example, a diffusion element can include features to diffuse or scatter light, such as scattering particles dispersed within the element (e.g., particles made from titanium dioxide, alumina, silicon carbide, gallium nitride, or glass micro spheres).

In embodiments in accordance with the present inventive subject matter that include a diffusion element (or plural diffusion elements), the diffusion element (or diffusion elements) can be positioned in any suitable location and orientation. In some embodiments in accordance with the present inventive subject matter, a diffusion element can be positioned adjacent to and covering an aperture of the lighting device.

In embodiments in accordance with the present inventive subject matter that include an obscuration element (or plural obscuration elements), the obscuration element (or obscuration elements) can be positioned in any suitable location and orientation. In some embodiments in accordance with the present inventive subject matter, an obscuration element can be positioned adjacent to and covering an aperture of the lighting device.

In some embodiments according to the present invention, two or more types of features can be provided in a single element. For example, a single structure can provide light control as well as diffusion and/or obscuration. Typically, where multiple types of features are provided in a single structure, different regions of the structure provide the different features, e.g., regions providing the different features are stacked on one another.

In some embodiments according to the present inventive subject matter, the lighting device further comprises a support on which the one or more light sources are mounted. In such embodiments, the support can be of made of any suitable material, and can be of any suitable size and shape.

The present inventive subject matter is also directed to a light fixture that comprises at least one lighting device as described herein. The light fixture can comprise a housing, a mounting structure, and/or an enclosing structure. Persons of skill in the art are familiar with, and can envision, a wide variety of materials out of which a fixture, a housing, a mounting structure and/or an enclosing structure can be constructed, and a wide variety of shapes for such a fixture, a housing, a mounting structure and/or an enclosing structure. A fixture, a housing, a mounting structure and/or an enclosing structure made of any of such materials and having any of such shapes can be employed in accordance with the present inventive subject matter.

For example, fixtures, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010-0102697), the entirety of which is hereby incorporated by reference as if set forth in its entirety;

U.S. patent application Ser. No. 12/469,819, filed on May 21, 2009 (now U.S. Patent Publication No. 2010-0102199), the entirety of which is hereby incorporated by reference as if set forth in its entirety; and U.S. patent application Ser. No. 12/469,828, filed on May 21, 2009 (now U.S. Patent Publication No. 2010-0103678), the entirety of which is hereby incorporated by reference as if set forth in its entirety.

In some embodiments according to the present inventive subject matter, including some embodiments that include or do not include any of the features as discussed above, the lighting device further comprises circuitry that delivers current from at least one energy source to the light source (or sources).

In some lighting devices according to the present inventive subject matter, there are further included one or more circuitry components, e.g., drive electronics for supplying and controlling current passed through the light source (or sources) in the lighting device. Persons of skill in the art are familiar with a wide variety of ways to supply and control the current passed through light sources, e.g., solid state light emitters, and any such ways can be employed in the devices of the present inventive subject matter. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired. For example, circuitry that may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety; and U.S. patent application Ser. No. 12/328,115, filed on Dec. 4, 2008 (now U.S. Patent Publication No. 2009-0184662), the entirety of which is hereby incorporated by reference as if set forth in its entirety.

The lighting devices according to the present inventive subject matter can further comprise any suitable electrical connector, a wide variety of which are familiar to those of skill in the art, e.g., an Edison connector (for insertion in an Edison socket), a GU-24 connector, etc., or may be directly wired to an electrical branch circuit.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

Energy can be supplied to the at least one light source from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 2:
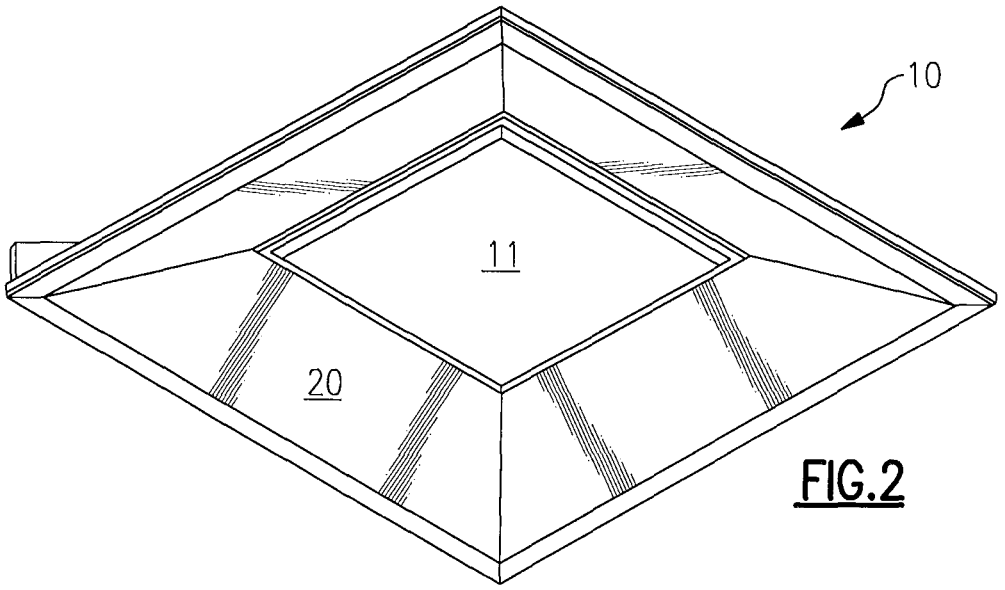
FIG. 2 is a perspective view of the lighting device 10 of FIG. 1.

FIG. 1 is a cross-sectional view of a lighting device 10 according to the present inventive subject matter, and FIG. 2 is a perspective view of the lighting device 10 of FIG. 1.

As seen in FIG. 1, the lighting device 10 also includes a light emitter board 14 mounted on the heat sink 12. The light emitter board 14 includes a plurality of light sources 21, which can be solid state light emitters, such as light emitting diodes (LEDs). The solid state light emitters can include light emitting diodes that emit blue light and light emitting diodes that emit red light, and the lighting device 10 can comprise luminescent material (e.g., as discussed below) that converts some of the blue light (i.e., light emitted by the light emitting diodes that emit blue light) into yellowish-green light or greenish yellow light, so that a mixture of light exiting the lighting device 10 is perceived as white light.

First and second major dimensions of the lighting device extend in a first plane (i.e., horizontally in the orientation shown in FIG. 1 and perpendicular to the plane of the paper in FIG. 1), and an emission plane for each of the light sources 21 is substantially parallel to the first plane.

The expression "emission plane of a light source," (e.g., "an emission plane for each of the light sources"), as used herein, means (1) a plane that is perpendicular to an axis of the light emission from the light source(s) (e.g., in a case where light emission is hemispherical, the plane would be along the flat part of the hemisphere; in a case where light emission is conical, the plane would be perpendicular to the axis of the cone), (2) a plane that is perpendicular to a direction of maximum intensity of light emission from the light source(s) (e.g., in a case where the maximum light emission is vertical, the plane would be horizontal), (3) a plane that is perpendicular to a mean direction of light emission (in other words, if the maximum intensity is in a first direction, but an intensity in a second direction ten degrees to one side of the first direction is larger than an intensity in a third direction ten degrees to an opposite side of the first direction, the mean intensity would be moved somewhat toward the second direction as a result of the intensities in the second direction and the third direction).

In some embodiments, the light emitter board can be a metal core printed circuit board on which light sources, e.g., light emitting diodes are mounted. The light emitter board 14 can be thermally coupled to the heat sink 12 and may be thermally coupled to the heat sink 12 by direct contact, a thermal adhesive or other technique known to those of skill in the art. In some embodiments, the light emitter board 14 may be eliminated and the solid state light emitters may be mounted directly to the heat sink 12. In such embodiments, i.e., where the solid state light emitters are mounted directly to the heat sink, the heat sink can be made such that it is adaptable to having the solid state light emitters mounted directly thereon using techniques used in making metal core printed circuit boards, e.g., by including a sheet of metal for providing an interconnection structure (e.g., three strings of light emitting diodes).

As is further illustrated in FIG. 1, the lighting device 10 also includes a light transmitting basket assembly 18. The basket assembly 18 may include a frame and a cover element 11. The cover element 11 may, for example, comprise an acrylic, polycarbonate, PET, PETG or other light transmissive material.

Figure 3:
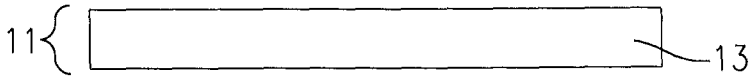
FIG. 3 depicts a representative example of a cover element that comprises a light control element for use in lighting devices according to the present inventive subject matter.

A representative example of a cover element 11 is depicted in FIG. 3. The cover element 11 shown in FIG. 3 is in the shape of a lens. The cover element 11 comprises a light control element 13 which can include one or more regions that comprise volumetric light control structures (or the entire light control element can comprise a volumetric light control structure), and/or it can include one or more regions (on either or both major surfaces) that comprise surface light control features). With this cover 11, each of the light sources 21 is spaced from the light control element 13 by substantially the same distance (i.e., the smallest distance from a point on the light source 21 to the nearest point on the light control element is substantially the same for each light source 21). The expression "substantially the same distance" when referring to first and second distances means that the first distance is between 0.90 to 1.10 times the second distance.

Figure 4:
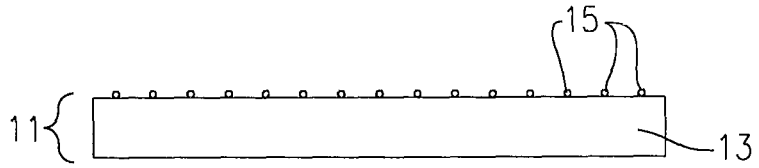
FIG. 4 depicts a representative example of a cover element that comprises a light control element for use in lighting devices according to the present inventive subject matter.

Another representative example of a cover element 11 is depicted in FIG. 4. The cover element 11 shown in FIG. 4 comprises a light control element 13 in the form of a lens that contains a volumetric light control structure (alternatively or additionally, either or both major surfaces of the light control element 13 can contain one or more regions that comprise surface light control features) and a luminescent material 15 coated on the upper surface (in the orientation depicted in FIG. 1) of the light control element 13. Alternatively (or additionally), luminescent material 15 can be provided on the lower surface of the light control element 13 and/or dispersed within the light control element 13, or it can be spaced from the light control element 13 and supported in any suitable way.

Figure 5:
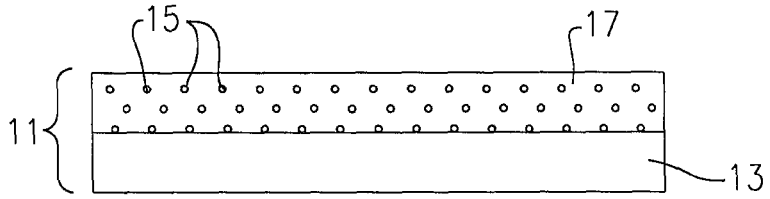
FIG. 5 depicts a representative example of a cover element that comprises a light control element for use in lighting devices according to the present inventive subject matter.

Another representative example of a cover element 11 is depicted in FIG. 5. The cover element 11 shown in FIG. 5 comprises a light control element 13 and a lumiphor 17 (comprising luminescent material 15 dispersed within epoxy) on the upper surface of the light control element 11.

Figure 6:
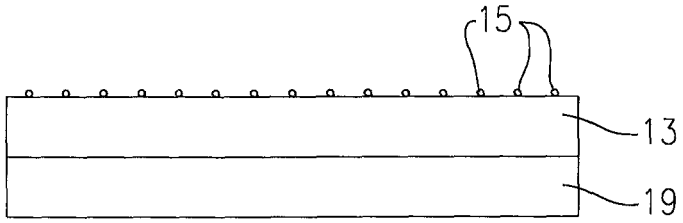
FIG. 6 depicts a representative example of a cover element that comprises a light control element for use in lighting devices according to the present inventive subject matter.

Another representative example of a cover element 11 is depicted in FIG. 6. The cover element 11 shown in FIG. 6 comprises a light control element 13 in the form of a film that contains a volumetric light control structure (alternatively or additionally, either or both major surfaces of the light control element 13 can contain one or more regions that comprise surface light control features) and a luminescent material 15 coated on the upper surface (in the orientation depicted in FIG. 1) of the light control element 13. Alternatively (or additionally), luminescent material 15 can be provided on the lower surface of the light control element 13 and/or dispersed within the light control element 13, or it can be spaced from the light control element 13 and supported in any suitable way. The light control element 13 is positioned on a lens 19.

Returning to FIG. 1, the basket assembly 18, the upper housing 16 and the light emitter board 14 provide a mixing chamber in which light emitted from the LEDs is mixed by a combination of reflection within the chamber and the optical properties of the diffusing structures and/or films of the basket assembly 18. Additionally, the interior surfaces of the mixing chamber may be covered in a reflective material, such as MCPET® from Furakawa Industries or any other reflective material, a wide variety of which are known by and available to persons skilled in the art (in some embodiments, particularly preferred reflective material is diffuse reflective material). Alternatively or additionally, any of the surfaces which light contacts can, in some embodiments, be coated with textured paint in order to alter brightness characteristics and/or patterns as desired.

Because many LEDs, such as Cree XRE LEDs, emit light in a substantially Lambertian distribution, the LEDs can be spaced from the sidewalls of the upper housing 16. Thus, the light emitter board can have a surface area that is smaller than the area defined by the opening of the upper housing 16 through which light passes. Accordingly, the upper housing or a portion of the upper housing may be substantially frustopyramidal and have sloped or slanted sidewalls 16 to direct light from the light emitter board 14 toward the basket assembly 18. Such slanted sidewalls may also help to direct light reflected from the basket assembly back toward the basket assembly so as to reduce light lost within the lighting device.

Additionally, because the light emitter board 14 may have a smaller area than the basket assembly 18, the configuration of the basket assembly 18 and the upper housing 16 may be such as to spread the light from the LEDs across visible surfaces of the basket assembly 18 so as to avoid abrupt changes in luminance of the basket assembly 18 and the side reflector 20. This may be accomplished, for example, with the mechanical configuration of the basket as described in U.S. patent application Ser. No. 12/116,341, filed May 7, 2008 (now U.S. Patent Publication No. 2008/0278952), the disclosure of which is incorporated herein as if set forth in its entirety, or by the optical properties of the lens(es) of the basket assembly as described below.

The side reflector 20 includes a flat lip portion 30 that can engage the grid of a suspended ceiling. Light exiting the lighting device 10 passes through a substantially square aperture defined by the lip portion 30 of the side reflector 20. The side reflector 20 recesses the light generation portion of the lighting device 10 above the plane of the ceiling tile.

In one example of a representative embodiment, the outer perimeter of the rim measures about 2 feet by about 2 feet, and the outer perimeter of the basket assembly measures about 1 foot by about 1 foot. In the cases of embodiments where the opening in the supporting structure is not square, e.g., 2 feet by 4 feet, the devices according to the present inventive subject matter can be modified in any suitable way to provide the desired effect in the opening, e.g., to fill it, such as by using two devices (each measuring about 2 feet by 2 feet) side-by-side, or by providing a device in which the outer perimeter of the rim measures about 4 feet by about 2 feet.

Figure 7:
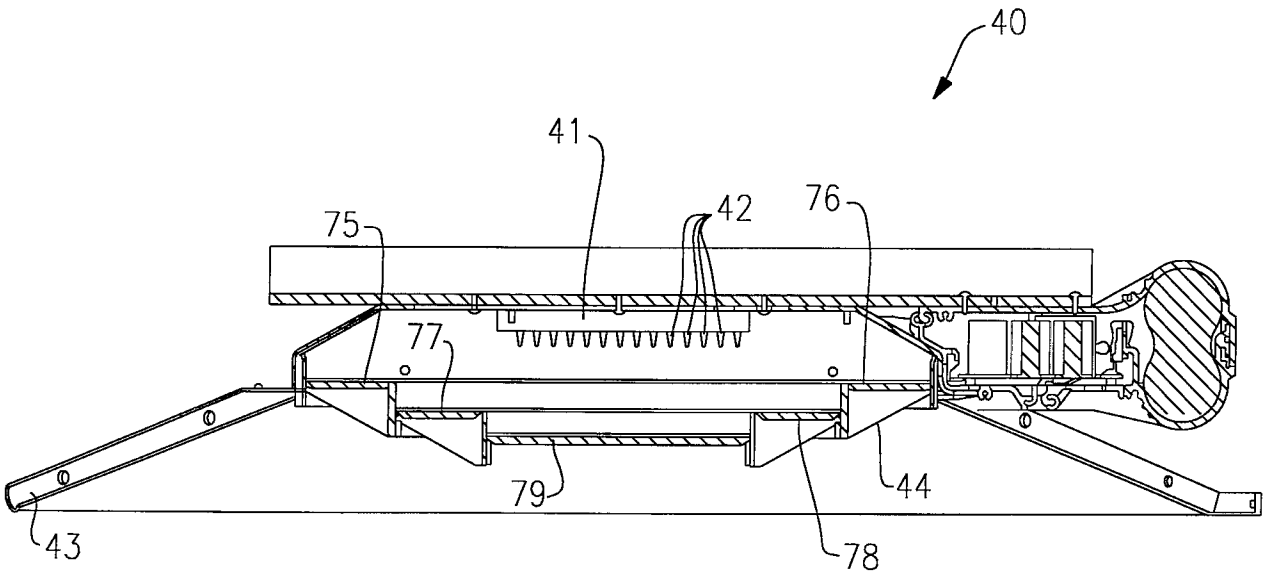
FIG. 7 is a cross-sectional view of a lighting device 40 according to the present inventive subject matter.
Figure 8:
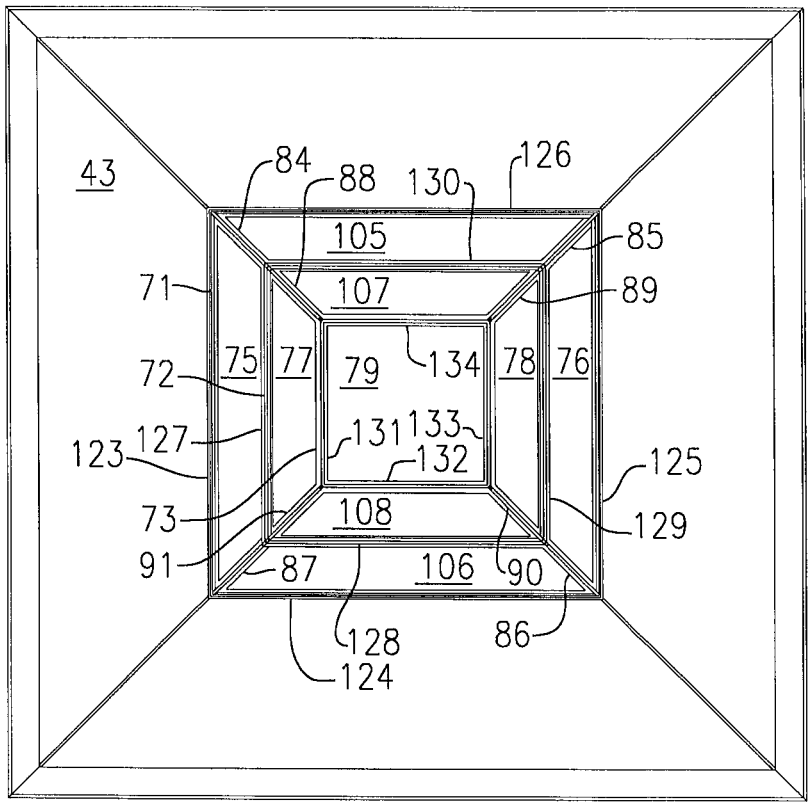
FIG. 8 is a bottom view of the lighting device 40 of FIG. 7.

FIG. 7 is a cross-sectional view of a lighting device 40 according to the present inventive subject matter, and FIG. 8 is a bottom view of the lighting device 40 of FIG. 7.

Referring to FIG. 7, the lighting device 40 includes a light emitter board 41, a plurality of light sources 42, a side reflector 43, a baffle assembly 44 and a plurality of cover elements 75, 76, 77, 78, 79, 105, 106, 107 and 108 (described below).

Referring to FIG. 8, the baffle assembly 44 comprises an outer baffle structure 71, an intermediate baffle structure 72 and an inner baffle structure 73. The outer baffle structure 71 includes four baffle elements 123, 124, 125, 126. Similarly, intermediate baffle structure 72 includes four baffle elements 127, 128, 129, 130, and the inner baffle structure 73 includes four baffle elements 131, 132, 133, 134. The baffle assembly 44 further comprises connector portions 84, 85, 86, 87 extending from the outer baffle structure 71 to the first intermediate baffle structure 72, and connector portions 88, 89, 90, 91 extending from the first intermediate baffle structure 72 to the inner baffle structure 73.

Baffle structures (e.g., the outer baffle structure, the first intermediate baffle structure and the inner baffle structure) (if present), and/or side reflectors (if present) can be formed of any suitable material. Persons of skill in the art are familiar with a wide variety of suitable materials, including a variety of materials which are known for use in making baffles and/or side reflectors for light fixtures. A representative example of a suitable material for use in making the baffle structures and/or the side reflectors is MCPET®, marketed by Furukawa (a Japanese corporation).

The embodiment depicted in FIGS. 7 and 8 includes a plurality of cover elements, namely, a first cover element 75 positioned between the baffle element 123 and the baffle element 127. Similarly:

a second cover element 76 is positioned between the baffle element 125 and the baffle element 129, a third cover element 77 is positioned between the baffle element 127 and the baffle element 131, a fourth cover element 78 is positioned between the baffle element 129 and the baffle element 133, a fifth cover element 79 is positioned between the baffle element 131 and the baffle element 133, and between the baffle element 132 and the baffle element 134, a sixth cover element 105 is positioned between the baffle element 126 and the baffle element 130, a seventh cover element 106 is positioned between the baffle element 124 and the baffle element 128, an eighth cover element 107 is positioned between the baffle element 130 and the baffle element 134, and a ninth cover element 108 is positioned between the baffle element 128 and the baffle element 132.

Any of the cover elements 75, 76, 77, 78, 79, 105, 106, 107 and 108 can be a cover element as described herein, e.g., any of the cover elements 11 depicted in FIG. 3, FIG. 4, FIG. 5 and FIG. 6.

Figure 9:
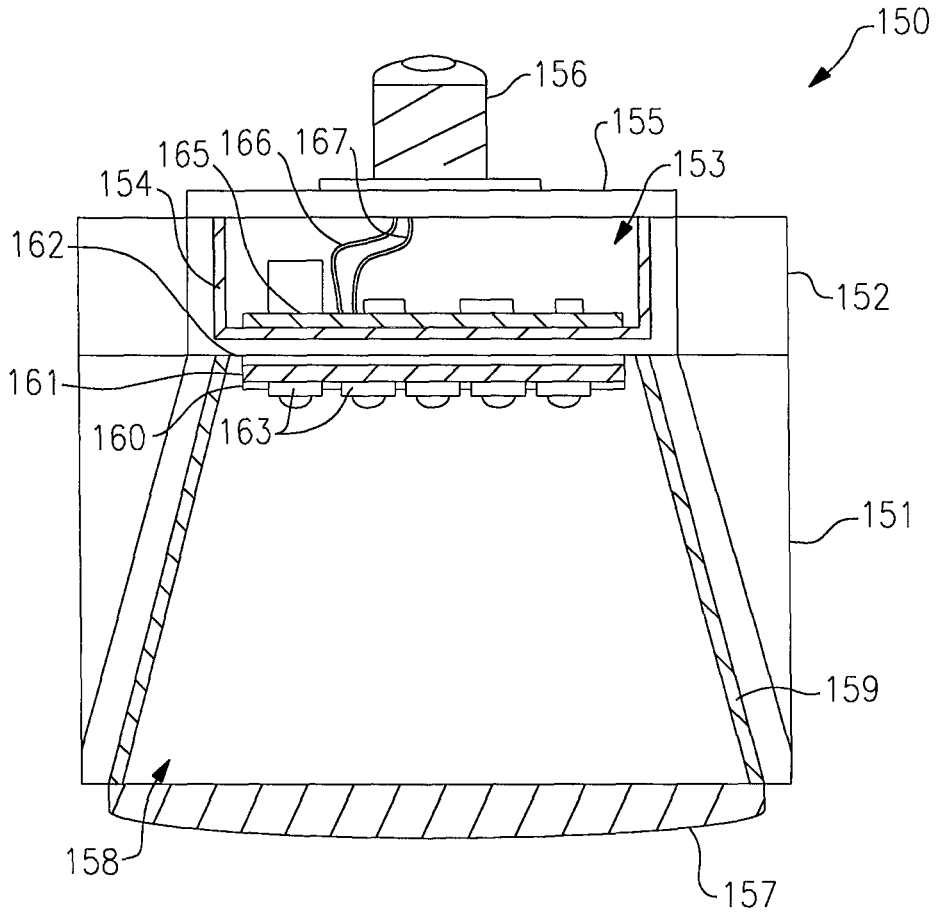
FIG. 9 is a schematic diagram of a lighting device 150 according to the inventive subject matter.

FIG. 9 is a schematic diagram of a lighting device 150 according to the present inventive subject matter. The lighting device 150 includes a lower housing 151, an upper housing 152, a cover element 157 and light sources 163. The lower housing 151 is a cast aluminum housing having fins surrounding the circumference and provides sidewalls of the mixing enclosure 158. The lower housing may be a lower housing of an LR6 fixture from Cree LED Lighting Solutions, Inc., Durham, N.C., with the trim flange removed such that the housing does not extend past the cover element 157. Other suitable lower housing materials having similar thermal properties could also be utilized. The lower housing 151 and the cover element 157, in combination, comprise an enclosing structure that surrounds the light sources 163.

The upper housing 152 includes a cavity 153 and also has fins to increase the overall area for heat extraction. The upper housing 152 has substantially the same configuration as the upper housing of the LR6 fixture. In the present embodiment, the upper housing 152 is made from copper. Other suitable upper housing materials having similar thermal properties could also be utilized. For example, the upper housing could be made from aluminum or other thermally conductive material. An electrically insulating layer 154 is provided within the upper housing 152 to isolate the power supply 165 from the upper housing 152. The insulating layer 154 may, for example, be Formex. A thermal gasket (not shown) can be provided between the upper housing 152 and the lower housing 151 to assure a good thermal coupling between the two housings. The thermal gasket may, for example, be Sil-Pad from The Bergquist Company.

A top plate 155 is provided on the upper housing 152 and encloses the cavity 153. A connector 156, such as an Edison type screw connector, is provided on the top plate 155 to allow connection of the lighting device 150 to a power source, such as an AC line. Other connector types could be utilized and may depend on the power source to which the lighting device 150 is to be connected.

The cover element 157 is provided on the opening of the lower housing 151 to provide a mixing enclosure 158 having sidewalls defined by the lower housing 151 and opposing ends formed by the upper housing 152 and the cover element 157. The cover element 157 can have a full width, half max (FWHM) of between 50° and 60°, which balances light transmission with diffusion to obscure the light sources.

The mixing enclosure 158 is lined with a highly reflective material 159, such as MCPET® from Furakawa, to reduce losses from light reflected back into the mixing enclosure 158 by the cover element. The highly reflective material 159 reflects between 98% and 99% of the light across the visible spectrum. The lower (in the orientation depicted in FIG. 7) end of the reflective material 159 defines a substantially circular aperture (through which substantially all of the light exiting the lighting device 150 exits. A reflective material 160 is also provided on a copper metal core circuit board 161 and may be provided on any exposed portions of the upper housing 152. The reflective material 160 can also be MCPET®, laser cut to fit around the light sources 163.

The light sources 163 are serially connected in a single string. This provides a high voltage string that allows for increased efficiency in driving the light sources 163.

The power supply 165 is connected to the Edison connector 156 through wires 166 and 167.

The cover element 157 can be a cover element as described herein, e.g., any of the cover elements 11 depicted in FIG. 3, FIG. 4, FIG. 5 and FIG. 6.

Figure 10:
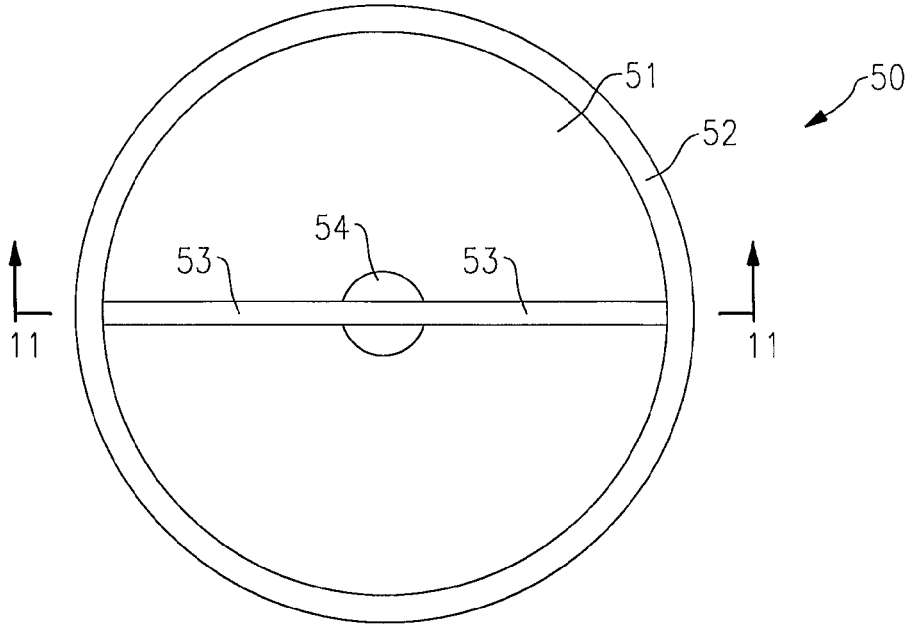
FIG. 10 illustrates a lighting device 50 in accordance with the present inventive subject matter.
Figure 11:
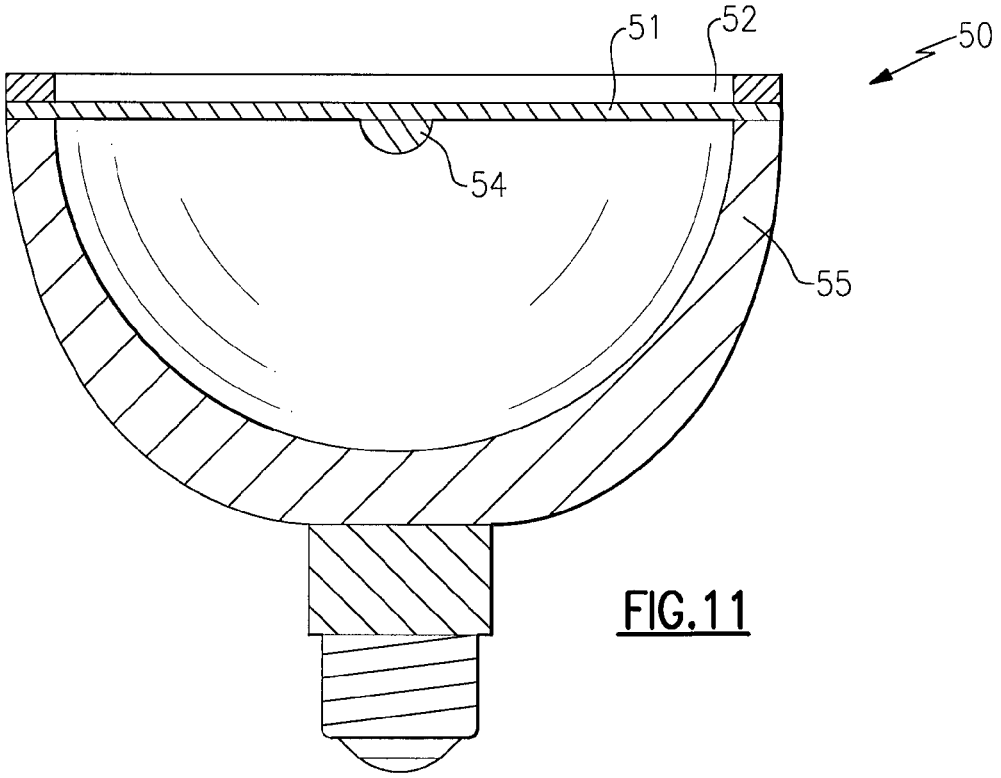
FIG. 11 is a sectional view of the lighting device 50 taken along the plane 11-11.

FIGS. 10-11 illustrate a lighting device 50 in accordance with the present inventive subject matter. FIG. 10 is a top view of the lighting device 50. FIG. 11 is a sectional view of the lighting device 50 taken along the plane 11-11.

Referring to FIGS. 10-11, the lighting device 50 is a back-reflector, and comprises a cover element 51, a rim 52, a conductive trace 53, a light source 54, and a housing 55. The surface of the housing 55 that faces the light source 54 is highly reflective.

The cover element 51 covers an aperture defined by the housing 55. The cover element 51 can be a cover element as described herein, e.g., any of the cover elements 11 depicted in FIG. 3, FIG. 4, FIG. 5 and FIG. 6.

The ability of the housing 55 to reflect light can be imparted in any suitable way, a variety of which are well known to persons of skill in the art. For example, the reflector(s) can comprise one or more material that is reflective (and/or specular, the term "reflective" being used herein to refer to reflective and optionally also specular), and/or that can be treated (e.g., polished) so as to be reflective, or can comprise one or more material that is non-reflective or only partially reflective and that is coated with, laminated to and/or otherwise attached to a reflective material. Persons of skill in the art are familiar with a variety of materials that are reflective, e.g., metals such as aluminum or silver, a dielectric stack of materials forming a Bragg Reflector, a dichroic reflector coating on glass (e.g., as described at www.lumascape.com/pdf/literature/C1087US.pdf), any other thin film reflectors, etc. Persons of skill in the art are familiar with a wide variety of materials which are suitable for making a non-reflective or partially reflective structure which can be coated with, laminated to or otherwise attached to a reflective material, including for instance plastic materials such as polyethylene, polypropylene, natural or synthetic rubbers, polycarbonate or polycarbonate copolymer, PAR (poly(4,4'-isopropylidene-diphenylene terephthalate/isophthalate) copolymer), PEI (polyetherimide), and LCP (liquid crystal polymer). The reflector(s) can be formed out of highly reflective aluminum sheet with various coatings, including silver, from companies like Alanod (http://www.alanod.de/opencms/alanod/index.htm_12063069299.html.), or the reflector(s) can be formed from glass. In cases where a lighting device according to the present inventive subject matter comprises more than one reflector, the respective reflectors can be made of the same material, or any reflector(s) can be made of different materials.

Representative examples of suitable reflectors (and arrangements thereof) are described in many patents, e.g., U.S. Pat. Nos. 6,945,672, 7,001,047, 7,131,760, 7,214,952 and 7,246,921 (the entireties of which are hereby incorporated by reference), each of which describes, among other things, back-reflectors.

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device, comprising:

at least a first light control element comprising light control structures;

at least a first light source positioned so that at least a portion of light emitted by the first light source passes through at least a portion of the first light control element;

at least a first luminescent material, at least a portion of the first luminescent material spaced from the first light source, the first luminescent material positioned so that at least a portion of light emitted by the first light source excites at least a portion of the first luminescent material, wherein each light control structure causes light that is incident on the light control structure to be at least one of (1) collimated, in which at least 50% of incident light is caused to travel in a first direction or substantially parallel to the first direction, and (2) distributed, in which comparatively less light incident on the light control structure is directed to a location directly below the light control structure and comparatively more light is directed to one or more locations spaced from directly below the light control structure.

2. A lighting device as recited in claim 1, wherein the light control element comprises a film comprising at least one region that comprises volumetric light control structures.

3. A lighting device as recited in claim 2, wherein:

the film comprises a first surface and a second surface, at least a portion of the first luminescent material is on the first surface of the film, and the first surface of the film is closer to the first light source than the second surface of the film.

4. A lighting device as recited in claim 1, wherein the light control element comprises a film comprising at least one region that comprises surface light control features.

5. A lighting device as recited in claim 4, wherein:

the film comprises a first surface and a second surface, at least a portion of the first luminescent material is on the first surface of the film, the first surface of the film is closer to the first light source than the second surface of the film, and the at least one region that comprises surface light control features is on the second surface of the film.

6. A lighting device as recited in claim 1, wherein the light control element comprises a lens comprising at least one region that comprises volumetric light control structures.

7. A lighting device as recited in claim 6, wherein:

the lens comprises a first surface and a second surface, at least a portion of the first luminescent material is on the first surface of the lens, and the first surface of the lens is closer to the first light source than the second surface of the lens.

8. A lighting device as recited in claim 6, wherein the lens is injection molded or extruded.

9. A lighting device as recited in claim 1, wherein the light control element comprises a lens comprising at least one region that comprises surface light control features.

10. A lighting device as recited in claim 9, wherein:

the lens comprises a first surface and a second surface, at least a portion of the first luminescent material is on the first surface of the lens, the first surface of the lens is closer to the first light source than the second surface of the lens, and the at least one region that comprises surface light control features is on the second surface of the lens.

11. A lighting device as recited in claim 9, wherein the lens is injection molded or extruded.

12. A lighting device as recited in claim 1, wherein the lighting device comprises a plurality of light sources including the first light source, the plurality of light sources mounted on a support, each of the plurality of light sources spaced from the light control element by substantially the same distance.

13. A lighting device as recited in claim 1, wherein the lighting device further comprises a baffle system and a side reflector, the baffle system comprising a plurality of baffle elements.

14. A lighting device as recited in claim 1, wherein the lighting device further comprises a side reflector, and light exiting the lighting device passes through an aperture defined by the side reflector.

15. A lighting device as recited in claim 14, wherein the aperture is of a shape selected from among substantially square, substantially rectangular and substantially circular.

16. A lighting device as recited in claim 1, wherein first and second major dimensions of the lighting device extend in a first plane, and an emission plane of the first light source is substantially parallel to the first plane.

17. A lighting device as recited in claim 1, wherein the first light source comprises at least one solid state light emitter.

18. A lighting device as recited in claim 1, wherein the first light source comprises at least one light emitting diode.

19. A lighting device as recited in claim 1, wherein the first direction is substantially perpendicular to a surface of the light control element.

* * * * *

UNITED STATES PATENT AND TRADEMARK OFFICE

CERTIFICATE OF CORRECTION

PATENT NO. : 8,967,821 B2
APPLICATION NO. : 13/425702
DATED : March 3, 2015
INVENTOR(S) : Paul Kenneth Pickard It is certified that error appears in the above-identified patent and that said Letters Patent is hereby corrected as shown below:

Title Page, Page 4, Right Column, Item (56) Other Publications:

Please change "“NARENDRAN et al., *Color Rendering Properties of LED Light Sources*, Lighting Reserach Center, Renssalaer Polytechnic Institute, pp. 1-8, 2002.” to -- NARENDRAN et al., *Color Rendering Properties of LED Light Sources*, Lighting Research Center, Renssalaer Polytechnic Institute, pp. 1-8, 2002. --

Title Page, Page 5, Left Column, Item (56) Other Publications:

Please change "KRAMES et al., *Lumileds Lighting, Light from Silicon Valley*, Progress and Future Direction of LED Technology, SSL Workshop, Nov. 13, 2003, Publisher: Limileds Lighting Inc., pp. 1-21.” to -- KRAMES et al., *Lumileds Lighting, Light from Silicon Valley*, Progress and Future Direction of LED Technology, SSL Workshop, Nov. 13, 2003, Publisher: Lumileds Lighting Inc., pp. 1-21. --

Signed and Sealed this
Fifteenth Day of September, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,967,821 B2
APPLICATION NO. : 13/425702
DATED : March 3, 2015
INVENTOR(S) : Paul Kenneth Pickard It is certified that error appears in the above-identified patent and that said Letters Patent is hereby corrected as shown below:

Title Page, Page 5, Right Column, Item (56) Other Publications, Lines 4 thru 7:

Please change "Light Emitting Diodes (LEDs) for General Illumination, OIDA, edited by Tsao, J.Y. Sandia National Laboratories, October 2002 available at http://lighting.sandia.gov/lgithingdocs/OIDA SSL LED Roadmap Full.pdf as retrieved on June 10, 2004." to -- Light Emitting Diodes (LEDs) for General Illumination, OIDA, edited by Tsao, J.Y. Sandia National Laboratories, October 2002 available at http://lighting.sandia.gov/lightingdocs/OIDA SSL LED Roadmap Full.pdf as retrieved on June 10, 2004. --

Signed and Sealed this
First Day of March, 2016

Michelle K. Lee

Michelle K. Lee
*Director of the United States Patent and Trademark Office*